US006295428B1

(12) United States Patent
Suzuki

(10) Patent No.: US 6,295,428 B1
(45) Date of Patent: Sep. 25, 2001

(54) IMAGE FORMING APPARATUS CARRYING CHARGED PARTICLES ON RESIN SLEEVE

(75) Inventor: Hiroyuki Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/461,764

(22) Filed: Dec. 15, 1999

(30) Foreign Application Priority Data

Dec. 17, 1998 (JP) ..... 10-359557

(51) Int. Cl.[7] ..... G03G 15/02
(52) U.S. Cl. ..... 399/168; 399/174
(58) Field of Search ..... 399/168, 175, 399/174; 361/225

(56) References Cited

U.S. PATENT DOCUMENTS 5,339,143 * 8/1994 Kunzmann ..... 399/384
5,341,165 8/1994 Suzuki et al. ..... 346/157
5,504,517 4/1996 Takashi et al. ..... 347/246
5,659,852 * 8/1997 Chigono et al. ..... 399/175
5,677,723 10/1997 Soya et al. ..... 347/247

FOREIGN PATENT DOCUMENTS 8-334918 * 12/1996 (JP) .
9-96997 4/1997 (JP) .

* cited by examiner

*Primary Examiner*—Quana M. Grainger
(74) *Attorney, Agent, or Firm*—Fitzpatrick, Cella, Harper & Scinto

(57) ABSTRACT

What is provided is an image forming apparatus in which a particle carrier is not contaminated with toner. The image forming apparatus comprises an image carrier for carrying a toner image, and charging means for charging the image carrier, the charging means having charged particles to be brought into contact with the image carrier and particle carrier carrying the charged particles and having a resin layer containing a conductive material on its surface.

7 Claims, 10 Drawing Sheets

IMAGE FORMING APPARATUS CARRYING CHARGED PARTICLES ON RESIN SLEEVE

BACKGROUND OF THE INVENTION

1. Field of the Invention

The present invention relates to an image forming apparatus, such as a copying machine or a printer, that uses electrophotography and electrostatic recording.

2. Related Background Art

FIG. 2 is a sectional view of a digital copying machine using electrophotography.

In this image forming apparatus shown in FIG. 2, when a copy start signal is input a charger 3 evenly charges the surface of a photosensitive drum 1 to a predetermined potential. A unit 9 is an original reader which is an integrated unit of an original lamp, a short-focus lens array, and a CCD sensor. When this unit 9 scans the surface of an original G placed on an original table 8 by irradiating its surface with light, the short-focus lens array of the unit 9 forms an image of the scanning light illuminating the original surface and reflected by it and feeds this image to the CCD sensor.

The CCD sensor includes a light-receiving unit, a transfer unit, and an output unit. The CCD light-receiving unit converts light reflected by the original surface and fed as described above as an optical signal, into an electric charge signal. The transfer unit sequentially transfers this electric charge signal to the output unit in synchronism with clock pulses. The output unit converts the electric charge signal into a voltage signal and outputs the signal after amplifying it and lowering its impedance. In this way, an analog signal fed as light reflected by the original surface is converted into a digital signal by the well-known processing, and this digital image signal is transferred to a printer unit. In this printer unit, a laser exposing means 2 scans light from a solid-state laser element, which turns on and off its emission upon reception of the image signal, by using a rotational polygonal mirror that rotates at high speed. This laser exposing means 2 forms an electrostatic latent image corresponding to the original image on the surface of the photosensitive drum 1 that is evenly charged.

A developing device 4 containing a so-called two-component developer mix having toner particles and carrier particles develops the electrostatic latent image formed on the surface of the photosensitive drum 1, thereby forming a toner image on the photosensitive drum 1. A transfer device 7 electrostatically transfers the toner image thus formed on the photosensitive drum 1 onto a transfer material. After that, the transfer material having the transferred toner image is electrostatically separated and conveyed to a fixing device 6, thermally fixed by this fixing device 6, and output as a fixed image.

In the image forming apparatus shown in FIG. 2, during the aforementioned image formation a cleaner 5 removes adhered contaminants, such as untransferred toner, from the surface of the photosensitive drum 1 after the toner image is transferred onto the transfer material, so that the photosensitive drum 1 can be used in repetitive image formation. This untransferred toner collected by the cleaner 5 is usually discarded as waste toner.

It is, however, preferable not to produce such waste toner in respect of environmental protection. In recent years, therefore, a so-called cleaner-less apparatus has appeared from which the cleaner 5 is removed and which cleans as it develops by the developing device 4. In this method, toner slightly remaining on the photosensitive drum 1 after a toner image is transferred is collected by a defogging potential difference $V_{back}$ which is the potential difference between the DC voltage applied to the developing device 4 and the surface potential of the photosensitive drum 1. This method can eliminate waste toner because untransferred toner is collected and used in the subsequent steps. Also, since no cleaner need to be used, the method is advantageous in respect of the internal space of the apparatus, so the apparatus can be greatly miniaturized.

Recently, a contact charging device, i.e., a device which charges an object to be charged (photosensitive drum) by bringing a voltage-applied charging member in contact with the object, has been put into practical use as the abovementioned charger for evenly charging the surface of the photosensitive drum 1. This is so because this device has the advantages of low ozone generation and low consumption power.

As the charging member used in the charging device of this type, a magnetic brush is preferably used because of the stability of charging contact. In a magnetic brush type contact charging device, conductive magnetic particles are magnetically constrained directly on a magnet, or on a sleeve containing a magnet, thereby forming a magnetic brush. This magnetic brush, as it is at rest or rotated, is brought into contact with an object to be charged and is applied with voltage to start charging.

Especially when such a contact charging device is used and an object to be charged is either a photosensitive body having a surface layer, in which fine conductive particles are dispersed, on a common organic photosensitive body or an amorphous silicon photosensitive body, a charging potential substantially equal to the DC component of the bias applied to the contact charging member can be obtained on the surface of the object to be charged. This method of charging is particularly called injection charging. When this injection charging method is used, an object to be charged is charged without using any discharge phenomenon, unlike in a method which usually uses a corona charger. Accordingly, completely ozoneless, low-power-consumption charging is possible, so the method has attracted attention recently.

Japanese Laid-Open Patent Application No. 9-096997 describes one example of the method which cleans as it develops by using this magnetic brush type contact charging device. The magnetic brush type contact charging device using magnetic particles is more advantageous to contamination by toner than a device using a conductive roller or the like. Also, this device is so constructed as to temporarily collect untransferred toner by magnetic particles and return the toner to a photosensitive body. Therefore, untransferred patterns are uniformly spurted and do not form patterns. This reduces the influence on image exposure.

Unfortunately, in an image forming apparatus using this contact charging system, if image formation is repetitively performed for long time periods while a developing means collects residual toner simultaneously with development without using any cleaner means, "positive ghost" occurs which is a phenomenon in which thin previous images remain because the developing means becomes unable to sufficiently collect untransferred toner. More specifically, this "positive ghost" occurs because portions of the photosensitive drum 1 below untransferred toner cannot be evenly charged when the contact charging member passes by. This phenomenon becomes conspicuous when the contact charging member is contaminated with toner.

This contamination of the contact charging member can be removed more advantageously when the contact charging member contains magnetic particles, than when a conductive roller or a conductive brush is used. If this is the case, however, toner particles having relatively high electrical resistance are commonly used as a developer mix. Therefore, when the apparatus is used for long time periods, the resin component of the toner particles becomes fused to the magnetic particles of the contact charging member by which the toner is temporarily collected, or additives added to the surfaces of these toner particles adhere to the magnetic particles. Consequently, contamination and the like of the conductive sleeve surface carrying the magnetic particles occur more significantly.

One cause of this contamination is toner having high electric charge. That is, toner having high electric charge is not easily discharged from the charging member onto the photosensitive body, owing to the influence of the magnetic mirror force, when temporarily collected by the charging member. If the friction between the magnetic particles, or between the magnetic particles and the magnetic particle carrier, is repeated in this state, fusion to the contact charging member is brought about. These phenomena raise the resistance of the whole or a part of the contact charging member. As a consequence, the surface of the photosensitive drum as an object to be charged can no longer be charged to a desired potential, or uneven charging takes place. The results are positive ghost as described above and some other image defects.

SUMMARY OF THE INVENTION

It is an object of the present invention to provide an image forming apparatus in which a particle carrier is not contaminated with toner.

It is another object of the present invention to provide an image forming apparatus in which the efficiency of discharge of toner from charged particles to an image carrier is high.

It is still another object of the present invention to provide an image forming apparatus comprising an image carrier for carrying a toner image, and charging means for charging the image carrier, the charging means having charged particles to be brought into contact with the image carrier and particle carrier carrying the charged particles and having a resin layer containing a conductive material on a surface.

Other objects, features and advantages of the invention will become apparent from the following detailed description taken in conjunction with the accompanying drawings.

DESCRIPTION OF THE PREFERRED EMBODIMENTS

Figure 1:
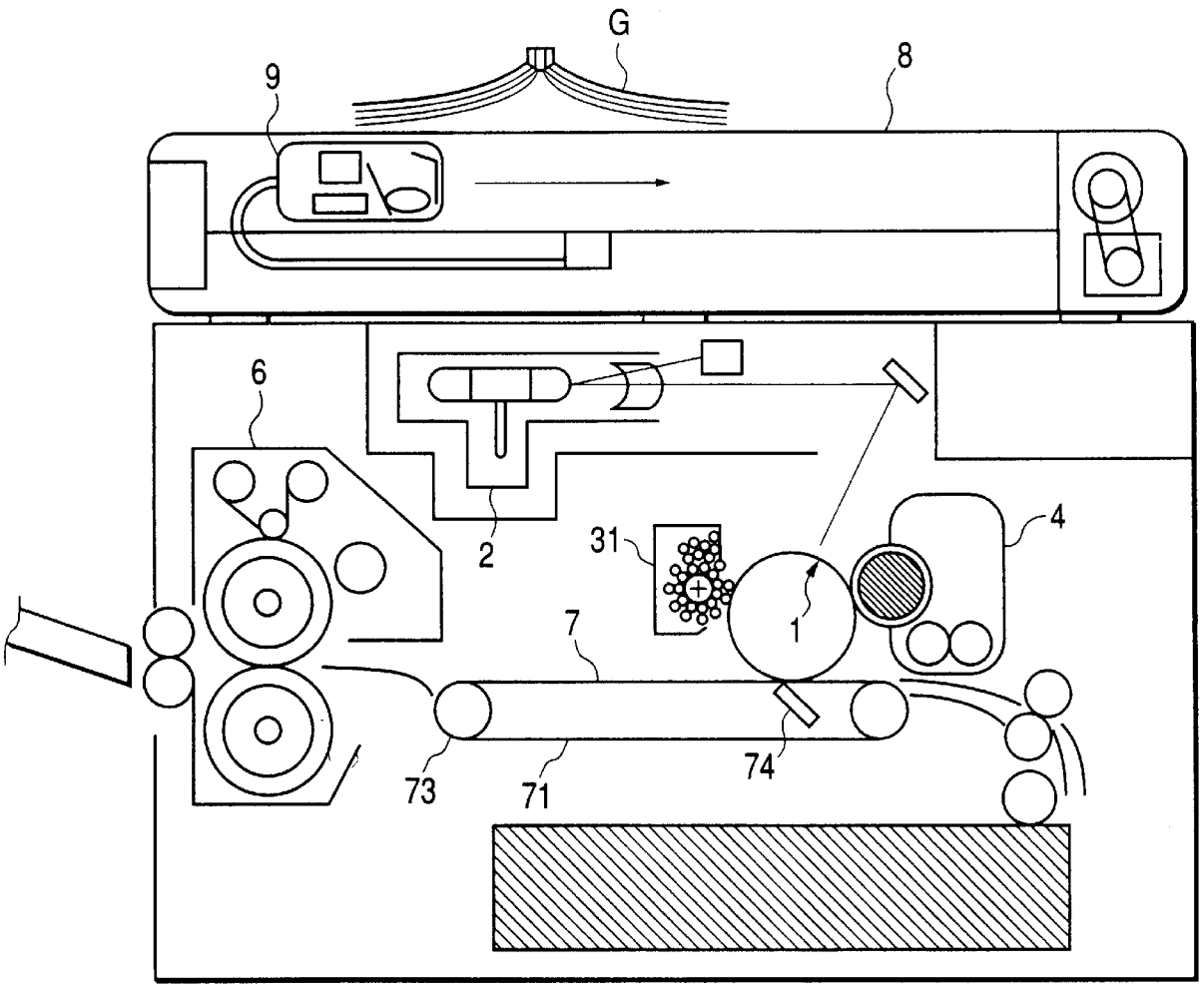
FIG. 1 is a sectional view for explaining an image forming apparatus of the present invention.
Figure 3:
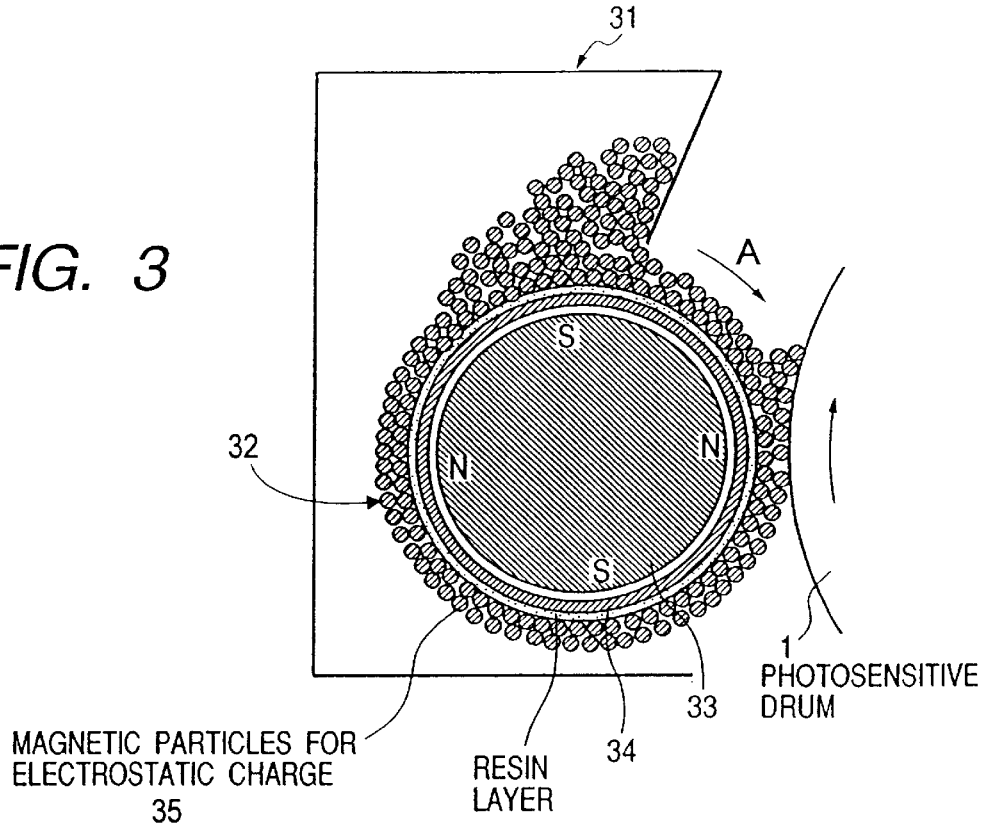
FIG. 3 is a schematic sectional view for explaining a magnetic brush charger constructing the image forming apparatus of the present invention.

FIG. 1 is a schematic sectional view of an image forming apparatus of the present invention. FIG. 3 is a schematic sectional view of a magnetic brush charger 31 as the principal characteristic feature of this image forming apparatus. The image forming apparatus of the present invention will be briefly described below with reference to these drawings.

As shown in FIG. 1, the image forming apparatus of the present invention does not have a cleaner 5 for collecting untransferred toner from a photosensitive drum 1 and a charger 3, as is apparent from the comparison with the conventional image forming apparatus described earlier. Instead, the image forming apparatus of the present invention has the magnetic brush charger 31. The rest of the arrangement is the same as the conventional image forming apparatus. Therefore, an original reader unit 9, a laser exposing means 2 as a latent image forming means, and the like are the same as in the prior art, so a detailed description thereof will be omitted.

First, this magnetic brush charger 31 as the principal characteristic feature of the image forming apparatus of the present invention will be described below.

FIG. 3 shows one example. As shown in FIG. 3, in this magnetic brush charger 31 used in the image forming apparatus of the present invention, a charging member 32 includes a magnetic particle carrier 34 carrying magnetic particles 35. A fixed magnet 33 is incorporated into this magnetic particle carrier 34. The image forming apparatus of the present invention is characterized in that the magnetic particle carrier 34 is formed by forming a resin layer, containing a fine conductive or semiconductive powder, on the surface of a substrate, or is made of a resin sleeve containing a fine conductive or semiconductive powder. The materials of these members constructing the magnetic brush charger 31 will be described below.

As the magnetic particles 35 for electrostatic charge carried on the magnetic particle carrier 34 to charge the photosensitive drum 1, it is preferable to use particles having an average particle size of 10 to 100 $\mu$m, a saturation magnetization of 20 to 250 emu/cm$^3$, and a resistance of $10^2$ to $10^{10}$ $\Omega$·cm. More preferably, the resistance is $10^6$ $\Omega$·cm or more when the existence of insulating defects such as pinholes on the photosensitive drum 1 is taken into consideration. To improve the charge efficiency, the resistance is preferably as small as possible. In the magnetic brush charger 31 shown in FIG. 3, magnetic particles 35 for electrostatic charge having an average particle size of 25 $\mu$m, a saturation magnetization of 200 emu/cm$^3$, and a resistance of $5\times10^6$ $\Omega$·cm were used. The material of the magnetic particles 35 for electrostatic charge was formed by oxidizing and reducing the surface of ferrite and adjusting the resistance as above.

The resistance value of the magnetic particles 35 for electrostatic charge used in this embodiment was measured by placing 2 g of the magnetic particles in a metal cell having a bottom area of 228 $mm^2$, loading 6.6 $kg/cm^2$, and applying a voltage of 100 V.

As described previously, in the magnetic brush charger 31 shown in FIG. 3, a rotatable nonmagnetic sleeve 34 having an outer diameter of 16 mm and containing the fixed magnet 33 is used as a magnetic particle carrier. The magnetic particles for electrostatic charge as described above are carried on this nonmagnetic sleeve 34. As shown in FIG. 3, the magnetic particles 35 for electrostatic charge carried on the nonmagnetic sleeve 34 are formed into the shape of a brush by the magnetic field and conveyed in the direction of an arrow A by the rotation of the nonmagnetic sleeve 34. The nonmagnetic sleeve 34 rotates in the counter direction with respect to the photosensitive drum 1 as shown in FIG. 3. In the magnetic brush charger 31 shown in FIG. 3, the nonmagnetic sleeve 34 rotates at a rotating speed of 150 m/sec, while the rotating speed of the photosensitive drum 1 is 100 mm/sec. In the present invention, image formation is preferably performed under conditions by which the ratio of the rotating speed of the photosensitive drum to that of the nonmagnetic sleeve is 1:0.5 to 1:3.

When charging voltage is applied to the nonmagnetic sleeve 34, the magnetic particles 35 for electrostatic charge give electric charge to the surface of the photosensitive drum 1. As a consequence, the photosensitive drum 1 is charged to a potential corresponding to the charging voltage. Note that the higher the rotating speed of the nonmagnetic sleeve, the better the charging uniformity.

The material of the nonmagnetic sleeve (magnetic particle carrier) usable in the magnetic brush charger 31 will be described below. In the image forming apparatus of the present invention, the magnetic particle carrier 34 is formed by forming a resin layer containing a fine conductive or semiconductive powder on the surface of a substrate, or is constructed of a resin sleeve containing a fine conductive or semiconductive powder.

Examples of the fine conductive or semiconductive powder are metal powders of, e.g., aluminum, copper, nickel, and silver; metal compounds such as potassium titanate and barium ferrite; short metal fibers; carbon fiber; conductive metal oxides such as antimony oxide, indium oxide, tin oxide, and zinc oxide; and conductive powders of, e.g., carbon black and graphite. Of these fine powders, graphite, particularly crystalline graphite is suitably used because it has lubricating properties in addition to conductivity and can therefore reduce adhesion of toner to the nonmagnetic sleeve.

Crystalline graphite is roughly classified into natural graphite and artificial graphite. Artificial graphite is formed by hardening pitch coke with tar pitch or the like, once baking the resultant material at about 1,200° C., placing the baked material in a graphitizing furnace, treating the material at a high temperature of about 2,300° C., and thereby growing crystals of carbon and changing it into graphite. Natural graphite is completely graphitized by terrestrial heat and high underground pressure over long periods of time and produced from underground. These graphites have diverse excellent properties and hence have wide industrial applications. Each of these graphites is a carbon crystal which is dark gray or black, lustrous, very soft, and lubricating, and is used in pencils and the like. In addition, since these graphites are heat-resistant and chemically stable, they are used in the form of a powder, solid, or paint as a lubricating material, refractory material, and electrical material. The crystal structure belongs to a rhombohedral system as a hexagonal system and has a completely layered structure.

The electrical characteristics of these graphites are that free electrons exist between carbon-to-carbon bonds, so they are electrically good conductors. In the present invention, either natural graphite or artificial graphite can be used. The particle size of graphite used is preferably about 0.5 to 20 $\mu$m.

As fine carbon particles (carbon black) as an example of the preferable fine conductive powders used in the present invention, conductive amorphous carbon can be used. The conductive amorphous carbon is generally defined as an "aggregate of crystals formed by burning, or thermally decomposing, hydrocarbon or a carbon-containing compound with insufficient air supply". This conductive amorphous carbon is particularly superior in electrical conductivity. Therefore, the conductive amorphous carbon can be charged in a polymer material to give conductivity to the material, or conductivity arbitrary to some extent can be obtained by controlling the addition amount. So, the conductive amorphous carbon is widely used as a conductive material. The particle size of the conductive amorphous carbon used in the present invention is preferably 10 to 80 nm, and more preferably, 15 to 40 nm.

One preferable form of the nonmagnetic sleeve constructing the charging member used in the image forming apparatus of the present invention has, on its surface, a resin layer consisting of the fine conductive or semiconductive powder as described above and a binder resin. In this structure, the resin layer formed preferably contains the aforementioned fine powder in an amount of 20 to 200 parts by weight, preferably, 30 to 150 parts by weight with respect to 100 parts by weight of the binder resin constructing the resin layer. That is, if the addition amount is less than 20 parts by weight, the effect of the added fine conductive powder is small. This makes it difficult to optimize or uniformize the charge amount of toner on the nonmagnetic sleeve. On the other hand, if the addition amount is larger than 200 parts by weight, the fine powder in the binder resin readily disperses unevenly, and the strength of the film itself easily deteriorates. Additionally, the conductivity of the nonmagnetic sleeve increases to make it difficult to give appropriate triboelectrification to toner.

As the binder resin forming the resin layer, it is possible to use, e.g., thermoplastic resins such as styrene-based resin, vinyl-based resin, polyethersulfone resin, polycarbonate resin, polyphenylene oxide resin, polyamide resin, fluorine resin, cellulose-based resin, and acryl-based resin; thermosetting resins such as epoxy resin, polyester resin, alkyd resin, phenolic resin, melamine resin; polyurethane resin, urea resin, silicone resin, and polyimide resin; and photosetting resins. Of these resins, it is more preferable to use a resin having releasability, such as silicone resin or fluorine resin, or a resin having good mechanical properties, such as polyethersulfone resin, polycarbonate resin, polyphenylene oxide resin, polyamide resin, phenolic resin, polyester resin, polyurethane resin, or styrene-based resin.

An example of the method of forming the resin layer constructing the nonmagnetic sleeve used in the present invention is a method which coats a nonmagnetic sleeve substrate with a coating solution containing the fine powder and the binder resin described above, and dries the coating solution to form a coating layer, thereby forming a resin-coated sleeve. More specifically, a fine powder of the aforementioned material mixture is well dispersed in a resin by using a disperser such as a sand mill. The obtained dispersion is diluted with an organic solvent to prepare a coating solution. This coating solution is applied to a nonmagnetic sleeve substrate by spraying, dried, and hardened to form a resin coating layer. A substrate on the surface of which this resin layer is to be formed is preferably a nonmagnetic conductor material such as SUS or aluminum.

The second preferred form of the nonmagnetic sleeve constructing the charging member used in the image forming apparatus of the present invention is a resin sleeve containing a fine conductive or semiconductive powder. This resin sleeve can be formed by using a resin containing the fine conductive or semiconductive powder. As an alternative, a molded resin sleeve can be carried on a substrate. Although any binder resin can be used provided that extrusion molding or injection molding is possible, a crystalline resin is particularly preferably used. That is, a crystalline resin easily forms passages of the contained fine powder along the circumferential surface of the resin crystal layer. Therefore, when resin sleeves of the same conductivity are formed, crystalline resin is preferred as the material because it requires a smaller amount of a fine powder used than required by a noncrystalline resin matrix.

As this crystalline resin, it is possible to preferably use, e.g., polyamide resin, polypropylene resin, polyethylene resin, polypropylene oxide resin, and polybutyleneterephthalate resin. Also, to manufacture a resin/fine powder composite material for forming the above resin sleeve, it is possible to add the fine powder while a crystalline resin is kneaded by a biaxial kneading extruder and to form the kneaded product into pellets by a pelletizer.

A commonly used organic photosensitive body or the like can be used as the photosensitive drum as an image carrier used in the image forming apparatus of the present invention. In the present invention, however, it is desirable to use an organic photosensitive body having a surface layer made from a material having a resistance of $10^9$ to $10^{14}$ Ω·cm or to use an amorphous silicon photosensitive body. This is so because it is possible to realize charge injection charging, prevent generation of ozone, and reduce the consumption power. It is also possible to improve the charge efficiency.

Any of these photosensitive bodies is evenly charged by the charging member, explained earlier, that characterizes the image forming apparatus of the present invention. The image exposing means performs image exposure for the charged image carrier to form an electrostatic latent image. The image forming apparatus of the present invention includes the developing means for developing the formed latent image with a developer mix carried by a developer mix carrier, thereby forming a toner image.

This developing step will be described below. As general electrostatic latent image developing methods, mono-component contact developing methods using no carrier are roughly classified into mono-component noncontact development and mono-component contact development. In the former method, a developer mix carrier (developing sleeve) is coated with a developer mix by using a blade or the like, if the developer mix is nonmagnetic toner, or by magnetic force, if the developer mix is magnetic toner, this developing sleeve carrying the developer mix is conveyed to a development region facing a photosensitive drum, and the toner is developed not in contact with the photosensitive drum. The latter method is to develop the toner, formed on the developing sleeve as described above, in contact with the photosensitive drum. Meanwhile, two-component contact developing methods using carrier are roughly classified into two-component contact development and two-component noncontact development. In the former method, a mixture of toner particles and magnetic carrier is used as a developer mix, and this developer mix is conveyed to a development region by magnetic force and developed in contact with a photosensitive drum. The latter method is to develop this two-component developer mix not in contact with a photosensitive drum. Of these methods, the two-component contact development is often used in respect of high image quality and high stability.

Next, as a practical case of development of an electrostatic latent image formed on the photosensitive drum of the image forming apparatus of the present invention, a development step which develops an image by a two-component magnetic brush method by using a developing device 4 shown in FIG. 4 and a circulating system for a developer mix in this case will be described below. A developing sleeve 11 rotates in the counter direction to the rotating direction of the photosensitive drum, and a developer mix drawn up by this rotation is conveyed. During the conveyance, a regulating blade 15 set perpendicularly to the developing sleeve 11 regulates the thickness of the developer mix and forms a thin layer of the developer mix on the developing sleeve 11. When this thin developer mix layer formed on the developing sleeve 11 is conveyed to a main developing electrode, toner chains are formed by the magnetic force. The toner chains develop an electrostatic latent image formed on the photosensitive drum 1. After that, the developer mix on the developing sleeve 11 is returned into a developer mix container 16 by the repulsive magnetic field of N electrodes.

A power supply (not shown) supplies DC and AC voltages to the developing sleeve 11. Generally, when AC voltage is applied in the two-component developing method, the development efficiency increases to improve the image quality. However, this also allows easy generation of fog. A common approach for preventing this fog is to produce a potential difference between the DC voltage applied to the developing device 4 and the surface potential of the photosensitive drum 1. This potential difference for preventing fog is called a defogging potential ($V_{back}$). This potential difference prevents adhesion of toner to a non-image region during development. Additionally, by this potential difference untransferred toner is collected in a cleaner-less apparatus such as the image forming apparatus of the present invention.

A toner image formed on the photosensitive drum surface by the above development step is, as shown in FIG. 1, transferred onto a recording material by a transfer device 7. In the apparatus shown in FIG. 1, this transfer device 7 is formed by extending an endless belt 71 between a driving roller 72 and a driven roller 73 and rotated in the direction of an arrow D in FIG. 1. The transfer device 7 also includes a transfer charging blade 74 which generates pressure from inside the transfer charging belt 71 toward the photosensitive drum 1. At the same time, a high-voltage power supply supplies power to charge in opposite polarity to that of the toner from behind the recording material. Consequently, the toner image on the photosensitive drum 1 is transferred onto the upper surface of the recording material. After that, the transfer material is conveyed to the fixing device 6, the toner image is thermally fixed there, and the image is output.

Figure 2:
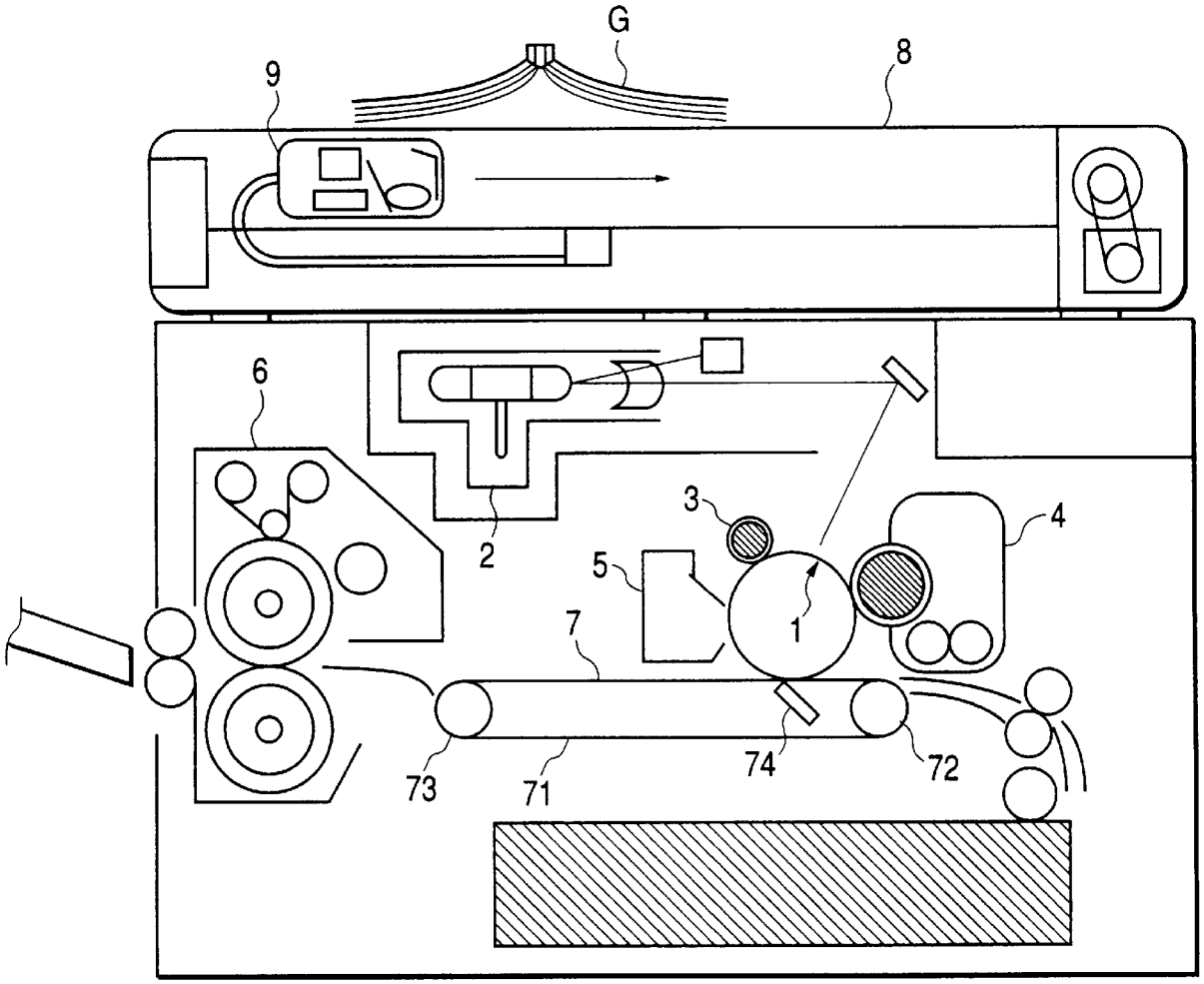
FIG. 2 is a sectional view showing a conventional image forming apparatus.

Untransferred toner remains on the photosensitive drum 1 subjected to the image output as described above. The image forming apparatus of the present invention does not include any cleaning means, unlike the conventional image forming apparatus shown in FIG. 2. So, the magnetic brush charger 31 charges with such untransferred toner remaining on it. As a consequence, during the photosensitive drum charging step again executed the untransferred toner is temporarily collected by the magnetic brush charger 31 by slide friction by a magnetic brush formed by the magnetic particles for electrostatic charge. The collected untransferred toner is made to have normal charging polarity by triboelectrification with the magnetic particles for electrostatic charge, and discharged onto the photosensitive drum. As described previously, this occurs because the charging potential is slightly lower than the applied bias. Additionally, in the development step the untransferred toner thus discharged onto the photosensitive drum is collected in the developing device 4, simultaneously with development, by the defogging potential ($V_{back}$), and the collected toner is reused.

As mentioned earlier, when image output is performed as described above, if the untransferred toner temporarily collected in the magnetic brush charger 31 is not reliably returned to the photosensitive drum, slide friction between the magnetic particles for electrostatic charge and a portion of the untransferred toner causes fusion of the toner or adhesion of additives to the magnetic particles. This raises the resistance of the magnetic particles for electrostatic charge. However, in the image forming apparatus of the present invention, the magnetic particle carrier for charging the magnetic particles for electrostatic charge has the specific arrangement described above. Hence, it is possible to give a suitable charging amount to the toner temporarily collected and mixed in the magnetic particles for electrostatic charge. As a consequence, the spurting efficiency of the toner to the photosensitive drum can be increased. This effectively prevents strong adhesion of toner to the charging member, which conventionally takes place owing to the generation of high-electric-charge toner or the mirror force of toner.

The present invention will be described in more detail below by way of its examples and comparative examples.

EXAMPLE 1

In this example, a nonmagnetic sleeve having a resin layer on its surface was used.

First, the surface of a drawn aluminum cylinder, as a nonmagnetic sleeve substrate, was sandblasted to form a roughened surface. A resin coating layer was formed on this roughened surface as described below to manufacture a nonmagnetic sleeve used in this example. The nonmagnetic sleeve thus manufactured had an outside diameter of 16 mm, an insertion hole inside diameter of 14.4 mm, a thickness of 0.7 mm, and a length of 248 mm.

The sandblasting was performed using Alundum abrasive grains. That is, the blasting was performed using a general air sandblasting machine (NUMABLASTER MANUFACTURED BY FUJI SEISAKUSHO) under the following conditions. Consequently, a nonmagnetic sleeve having a surface roughness (Ra) of 2.5 $\mu$m was obtained.

Blasting abrasive grains: Alundum #100

Blasting pressure: 2.5 kg/cm$^2$

Blasting time: 60 sec

Rotating speed: 20 rpm

Next, the surface of the nonmagnetic sleeve substrate thus obtained was coated with a coating solution with the following composition containing fine graphite particles and fine carbon black particles, thereby forming a coating layer. The surface roughness of the obtained resin-coated sleeve was found to be 3.0 $\mu$m.

| | |
|---|---|
| •Resin: phenolic resin | 100 parts by weight |
| •Graphite: average particle size (7 $\mu$m) | 45 parts by weight |
| •Carbon: average particle size (0.2 $\mu$m) | 5 parts by weight |
| •Solvent: IPA (IsoPropyl Alcohol) | 100 parts by weight |

In this example, a photosensitive drum having surface layers formed on a negatively charged organic photosensitive body by the following method was used. That is, a photosensitive drum manufactured by forming first to fifth functional layers, in this order from below, as surface layers on an aluminum drum substrate 30 mm in diameter was used.

The first layer is an undercoat layer for smoothing defects and the like of the aluminum substrate and is a 20-$\mu$m thick conductive layer. The second layer formed on this first layer is a positive charge injection preventing layer for preventing positive charge injected from the aluminum substrate from canceling negative charge on the photosensitive body surface. This second layer is a 1-$\mu$m thick medium-resistance layer whose resistance is adjusted to about $10^6$ $\Omega$·cm by melamine resin and methoxymethylated nylon.

The third layer is a charge generating layer about 0.3 $\mu$m thick in which a disazo-based pigment is dispersed in resin. This layer generates positive and negative charge pairs when exposed to light. The fourth layer is a charge transporting layer which is a p-type semiconductor in which hydrazone is dispersed in polycarbonate resin. Accordingly, negative charge on the photosensitive body surface cannot move through this layer; only positive charge generated by the charge generating layer can be transported to the photosensitive body surface.

The fifth layer is a charge injection layer which is a coating layer made from a material in which ultra fine $SnO_2$ particles are dispersed in an insulating resin binder. More specifically, $SnO_2$ particles about 0.03 $\mu$m in particle size, made to have low resistance (rendered conductive) by doping antimony as a light-transmitting insulating filler, were dispersed in an insulating resin at a ratio of 70% with respect to the resin, thereby preparing a coating solution. The fifth layer was formed by coating the fourth layer with this coating solution by, e.g., dipping coating, spray coating, roll coating, or beam coating. By using any appropriate one of these methods, a coating layer about 3 $\mu$m thick was formed as a charge injection layer on the fourth layer.

In a magnetic brush charger 31 used in this example, a contact nip width used between a photosensitive drum 1 with the above construction and magnetic particles for electrostatic charge constructing a charging member was adjusted to about 6 mm (FIG. 3). Also, to charge the photosensitive drum 1 a DC bias of −650 V was applied to the nonmagnetic sleeve of the charger 31.

Figure 4:
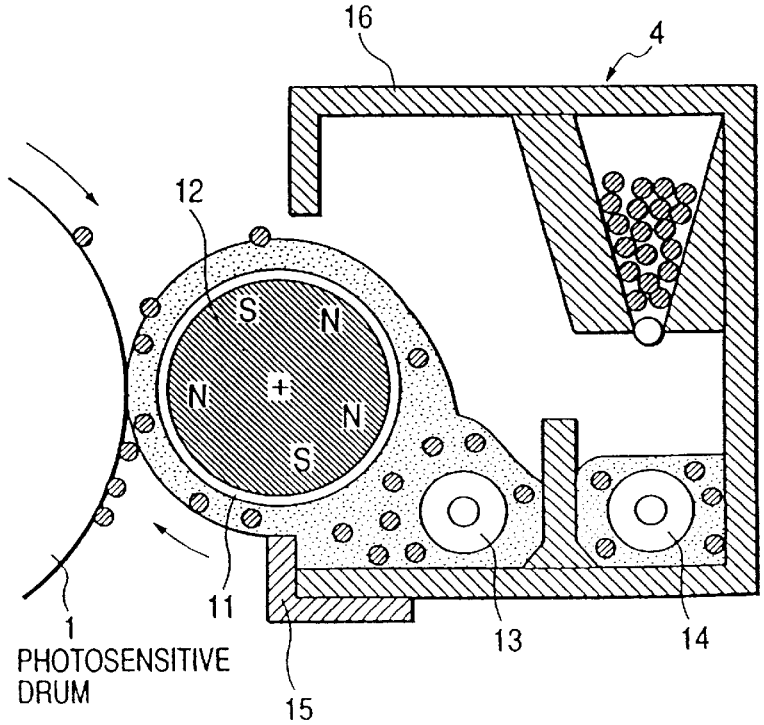
FIG. 4 is a schematic sectional view of a developing device constructing the image forming apparatus of the present invention and the conventional image forming apparatus.

FIG. 4 is a schematic view of a developing device used in this example to develop an electrostatic latent image formed on the surface of the photosensitive drum 1 constructed as above. In this example, a magnetic brush development type developing device using two-component developer mix was employed. Referring to FIG. 4, a magnet roller 12 is fixed in a developing sleeve 11. Screws 13 and 14 stir a developer mix. A regulating blade 15 forms a thin layer of a developer mix on the surface of the developing sleeve 11. A developer mix container 16 contains a developer mix. In this example, the developing sleeve 11 is set such that the closest distance to the photosensitive drum 1 is approximately 500 $\mu$m at least when development is performed, and that development can be performed with a developer mix in contact with the photosensitive drum 1. A power supply (not shown) supplies DC and AC voltages to the developing sleeve 11. In this example, −480 V was applied as DC voltage, and $V_{pp}$=1,500 V and $V_f$=3,000 Hz were applied as AC voltages. Generally, when AC voltage is applied in the two-component developing method, the development efficiency increases to improve the image quality. However, this also allows easy generation of fog. A common approach for preventing this fog is to produce a potential difference between the DC voltage applied to the developing device 4 and the surface potential of the photosensitive drum 1. This potential difference for preventing fog is called a defogging potential ($V_{back}$). This potential difference prevents adhesion of toner to a non-image region during development. Additionally, in a cleaner-less apparatus untransferred toner is collected by this potential difference.

A two-component developer mix used in this example was prepared as follows. Titanium oxide 20 nm in average particle size and silica 20 nm in average particle size were added at weight ratios of 1.0% and 1.0%, respectively, to negatively charged toner 6 μm in average particle size, and were thereby adhered to the surfaces of the toner particles. This toner was mixed with magnetic carrier for development having a saturation magnetization of 205 emu/cm$^3$ and an average particle size of 35 μm. That is, this magnetic carrier for development was mixed in the toner at a weight ratio of 8:92 to prepare a two-component developer mix. The triboelectrification amount of the toner contained in the two-component developer mix with this composition used in this example was found to be approximately $-25\times10^{-3}$ C/kg.

Figure 5:
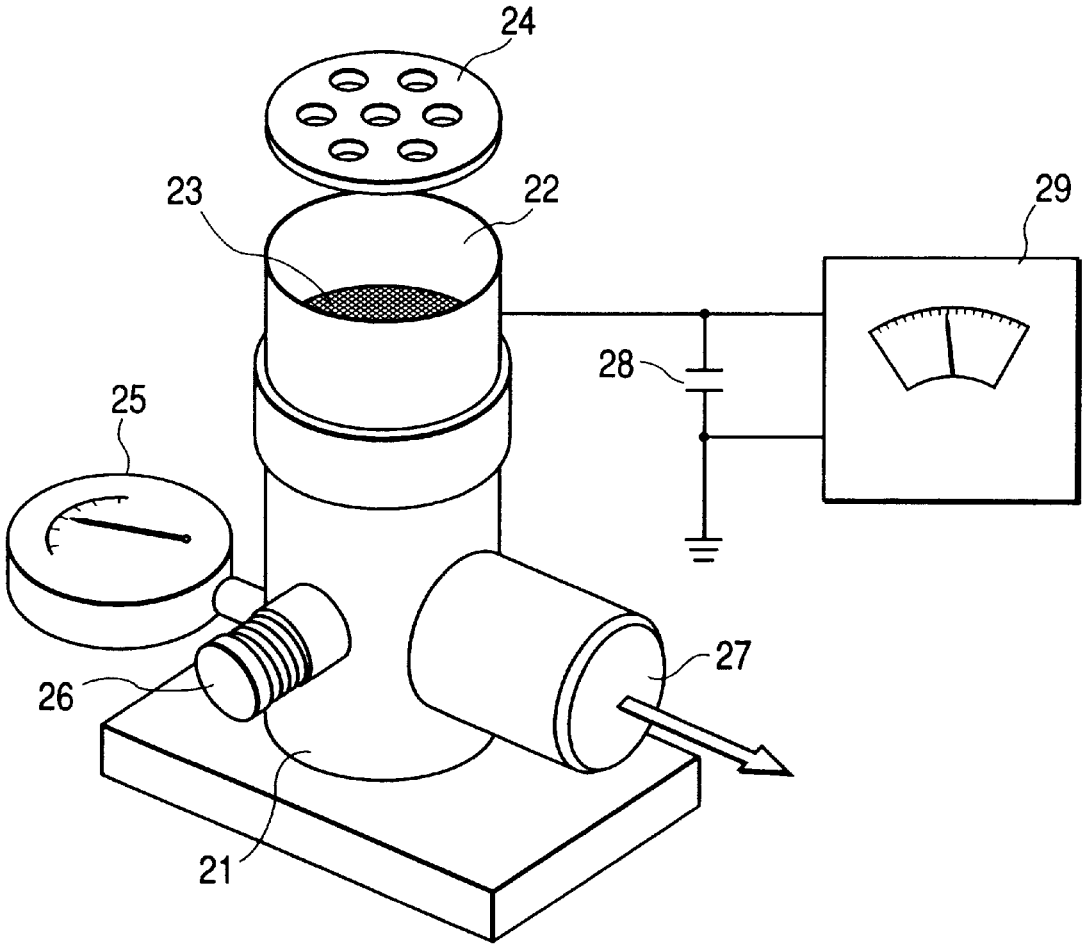
FIG. 5 is a perspective view of a measuring device used in toner triboelectrification amount measurements.

A method of measuring the triboelectrification amount of toner used in the present invention will be described below with reference to the accompanying drawings. FIG. 5 is a view for explaining a device for measuring the triboelectrification amount of toner. First, about 0.5 to 1.5 g of a two-component developer mix as a sample for measurement are placed in a metal measurement vessel 22 having an 800-mesh screen 23 on its bottom. A metal lid 24 is put on, and the weight of the whole measurement vessel 22 is measured as $W_1$ (kg). The sample for measurement is formed by placing a two-component developer mix, prepared by mixing toner particles as an object of triboelectrification amount measurement and magnetic carrier at a weight ratio of 5:95, in a 50- to 100-ml polyethylene bottle, and shaking the bottle with hands for about 10 to 40 sec.

Next, a suction device 21 (an insulator in at least a portion in contact with the measurement vessel 22) draws by suction from a suction hole 27. By adjusting a flow amount adjusting valve 26, the pressure of a vacuum meter 25 is set at 250 mmAq. In this state, the toner is removed by suction for a satisfactory time, preferably, 2 min. The potential of a potentiometer 29 is V (volt). A capacitor 28 has a capacitance C (F). The weight of the whole measurement device 22 after the suction is weighed as $W_2$ (kg). From these measurement values, the triboelectrification amount of the toner is calculated by $$\text{Toner triboelectrification amount}(C/\text{kg}) = \frac{C\times V\times10^{-3}}{W_1 - W_2}$$

The toner image formed on the photosensitive drum surface by the above development step is then transferred onto a recording material by the transfer device. After image output, untransferred toner remains on the photosensitive drum 1. Since the image forming apparatus of this example does not include any cleaning means, the magnetic brush charger 31 charges in the above state. In this charging step, the untransferred toner is temporarily collected in the magnetic brush charger 31 by slide friction by a magnetic brush formed by magnetic particles for electrostatic charge. The untransferred toner thus collected is made to have normal charging polarity (in this example, negative polarity) by triboelectrification with the magnetic particles for electrostatic charge, and is spurted onto the photosensitive drum (because the charging potential is slightly lower than the applied bias). In the development step, the untransferred toner thus returned onto the photosensitive drum is collected by the defogging potential ($V_{back}$) in the developing device 4 as it develops, and the collected toner is reused.

When image output is performed by the steps as described above, if the untransferred toner temporarily collected in the magnetic brush charger 31 is not reliably returned to the photosensitive drum, slide friction between the magnetic particles for electrostatic charge and a portion of the untransferred toner causes fusion of the toner or adhesion of additives to the magnetic particles. This raises the resistance of the magnetic particles for electrostatic charge.

The dependence of toner on the charging amount, which has large influence on the discharging properties of the collected untransferred toner, will be explained below. To study this dependence, magnetic particles for electrostatic charge were prepared by using the following five types of coating agents with which the magnetic particles were coated, in order to change the charging amount of toner. The coating agents used were formed by dispersing conductive particles such as carbon black in silicone resin and adjusting the resistance to a desired value, and were used at a ratio of 1.0 wt % with respect to the magnetic particles for electrostatic charge. As the resin, it is also possible to use a silicone-based, fluorine-based, or acryl-based resin.

Table 1 shows the results of measurements of toner triboelectrification amounts (C/kg) when five types of magnetic particles A, B, C, D, and E for electrostatic charge prepared as above were used. The measurements were performed following the same procedures as above except that samples for measurements were formed by mixing toner particles as an object of triboelectrification amount measurement and magnetic particles for electrostatic charge at a weight ratio of 3:97.

TABLE 1

The triboelectrification amount and the like of toner when different magnetic particles for electrostatic charge were used (a nonmagnetic sleeve having no resin coating was used)

| Magnetic particles for electrostatic charge | Toner triboelectrification amount (c/kg) | Toner concentration (%) after 100 copies |
|---|---|---|
| A | $+10\times10^{-3}$ | 1.02 |
| B | $-5\times10^{-3}$ | 0.08 |
| C | $-12\times10^{-3}$ | 0.12 |
| D | $-28\times10^{-3}$ | 0.35 |
| E | $-55\times10^{-3}$ | 0.87 |

Table 1 also shows the toner concentration (%) in magnetic particles for electrostatic charge when mixtures of magnetic particles for electrostatic charge and toner, mixed at the weight ratios used in the measurements of triboelectrification amounts described above, were used as the magnetic particles for electrostatic charge, a nonmagnetic sleeve having no resin coating like that used in the present invention was used, and 100 paper sheets were continuously copied in this state. As can be seen from Table 1, the toner concentration was high when the toner triboelectrification polarity was opposite to the normal charging polarity (A) and when the toner triboelectrification amount was large with the same polarity as the normal charging polarity (E).

The reasons for this are presumably as follows. In the case of (A) in which the triboelectrification polarity was opposite to the normal charging polarity, the charging potential was usually slightly lower than the applied bias, so the toner was attracted to the nonmagnetic sleeve by the electric field. In the case of (E) in which the triboelectrification amount was large with the same polarity as the normal charging polarity, the toner strongly adhered to the magnetic particles for electrostatic charge and to the magnetic sleeve owing to the influence of mirror force or the like, and this deteriorated the discharging properties.

In contrast, Table 2 below shows the results when the resin-coated sleeve used in the image forming apparatus of this example was used as a nonmagnetic sleeve. As is evident by comparing Tables 1 and 2, no effect was found when the triboelectrification polarity was opposite to the normal charging polarity (A). However, when triboelectrification had the same polarity as the normal charging polarity (B to E), the toner concentration reduced after 100 copies were formed. This is so because toner having a large charging amount hardly adhered to the nonmagnetic sleeve surface and triboelectrification itself was suppressed.

TABLE 2

The triboelectrification amount and the like of toner when different magnetic particles for electrostatic charge were used (a resin-coated sleeve was used as a nonmagnetic sleeve)

| Magnetic particles for electrostatic charge | Toner triboelectrification amount (c/kg) | Toner concentration (%) after 100 copies |
|---|---|---|
| A | $+10 \times 10^{-3}$ | 1.21 |
| B | $-5 \times 10^{-3}$ | 0.05 |
| C | $-12 \times 10^{-3}$ | 0.08 |
| D | $-28 \times 10^{-3}$ | 0.12 |
| E | $-55 \times 10^{-3}$ | 0.35 |

Figure 6:
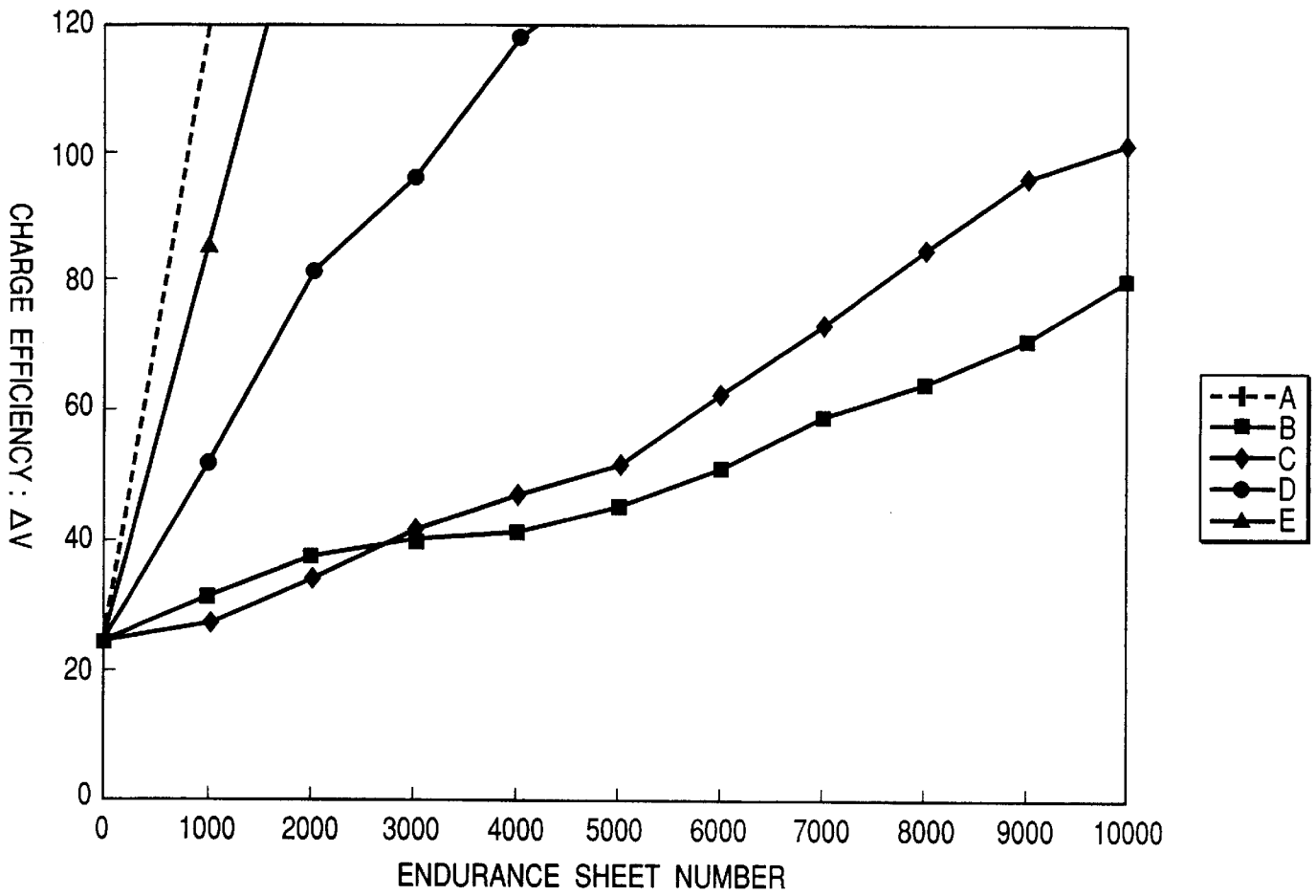
FIG. 6 is a graph showing variations in charge efficiency caused by endurance.

FIG. 6 shows variations in charge efficiency ΔV (=the difference between the saturation potential and the potential that can be charged in the first rotation) with an endurance of 10,000 copies, when a conventional nonmagnetic sleeve having no resin layer was used as a magnetic particle carrier. The results obtained by the magnetic particles A, B, C, D, and E for electrostatic charge are shown in FIG. 6. When the toner particles B and C were used, high-quality images could be output with no positive ghost up to 5,000 copies, and the endurance was possible up to 10,000 copies although positive ghost slightly appeared. However, the charge efficiency so lowered that no images could be output when about 1,000 copies were formed, in the case of the magnetic particles A and E for electrostatic charge, and when about 5,000 copies were formed, in the case of the magnetic particles D for electrostatic charge.

Figure 7:
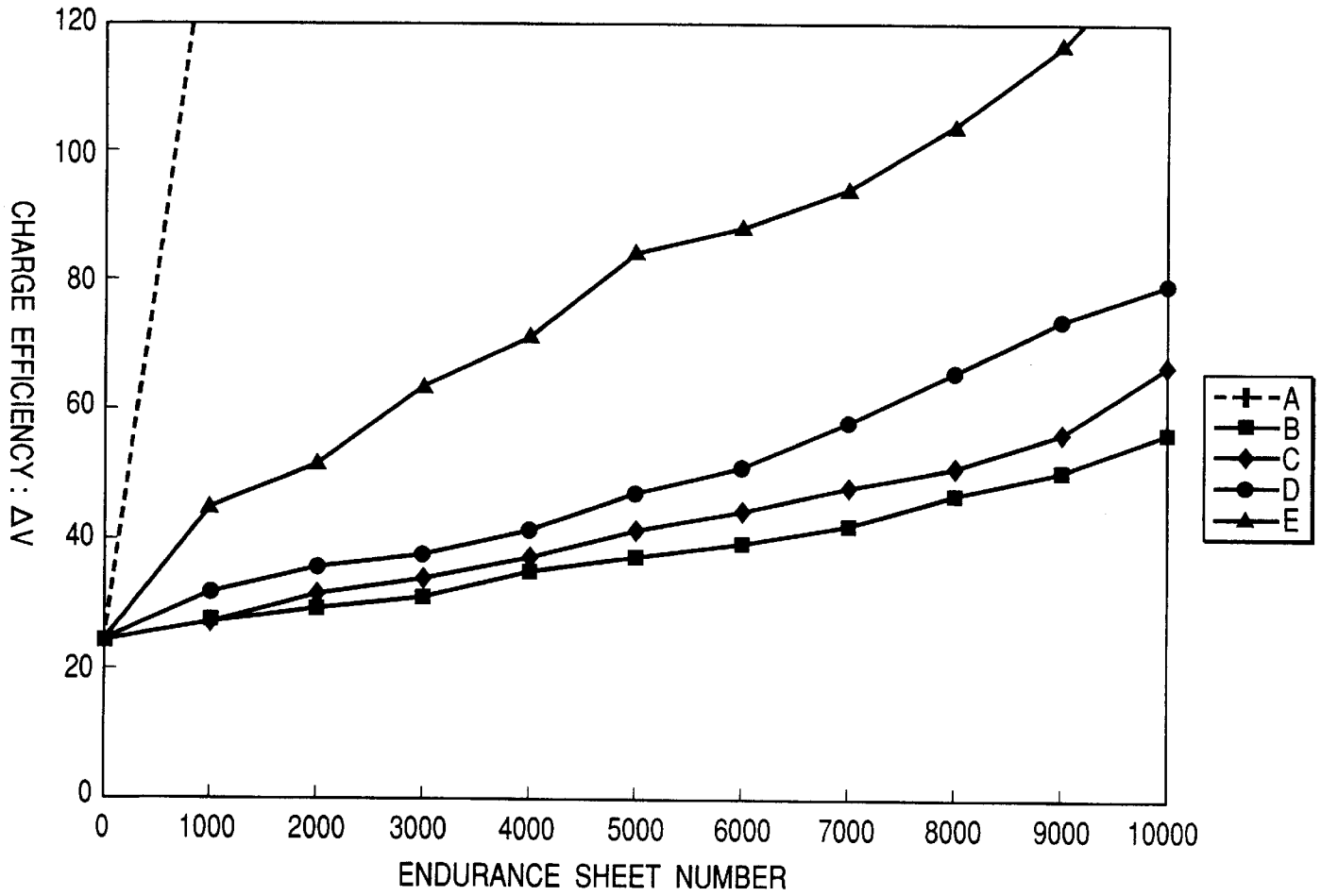
FIG. 7 is a graph showing variations in charge efficiency caused by endurance.

In contrast, FIG. 7 shows the results of an identical endurance image output test when the resin-coated sleeve used in this example was used. No effect was found when the magnetic particles A for electrostatic charge were used. However, images could be output with no positive ghost up to 8,000 copies when the magnetic particles B and C for electrostatic charge were used. Also, when the magnetic particles D for electrostatic charge were used it was possible to effectively prevent positive ghost up to 6,000 copies. Furthermore, when the magnetic particles E for electrostatic charge were used, images could be output up to 8,000 copies, although positive ghost started to appear when about 1,000 copies were formed.

As described above, when a resin-coated sleeve is used as a nonmagnetic sleeve, strong adhesion of toner to the surface of the nonmagnetic sleeve can be prevented. In addition, charge-up itself by triboelectrification can be suppressed. Consequently, when the resin-coated sleeve used in this example is used it is possible to increase the efficiency of discharging of toner from the magnetic brush charger 31 and maintain high charge efficiency.

EXAMPLE 2

In Example 1 above, the applied bias to the nonmagnetic blade of the magnetic brush charger 31 was a DC voltage of −650 V. In Example 2, the construction of a magnetic brush charger was the same as in Example 1, and the charging applied bias was formed by superposing an alternating voltage with a frequency of 1,000 Hz and an amplitude of 700 V on a DC voltage of −650 V. When an alternating voltage is applied, a charge efficiency ΔV (=the difference between the saturation potential and the potential that can be charged in the first rotation) can be greatly improved. In addition, it is possible to greatly enhance the effect of removing toner from the nonmagnetic blade during charging.

According to the examinations by the present inventors, these effects can be obtained by setting the frequency and amplitude of an alternating voltage to about 200 to 20,000 Hz and about 200 to 1,500 V, respectively. When an alternating voltage is superposed, it is possible to obtain the charge efficiency increasing effect and the effect of removing toner during charging. Also, a potential reduction is small when the same amount of toner is mixed. Accordingly, the spurting potential difference (applied bias—charging potential) is smaller than when only DC voltage is used as in Example 1, so a slightly large amount of toner is easily mixed. Therefore, it is preferable to superpose an alternating voltage within the above range.

Table 3 shows the results of measurements of toner triboelectrification amounts (C/kg) when five types of magnetic particles A, B, C, D, and E for electrostatic charge were used, and a nonmagnetic sleeve having no resin coating like that used in the present invention was used. The measurements were performed following the same procedures as explained above except that toner and magnetic particles for electrostatic charge were mixed at a weight ratio of 3:97. Table 3 also shows the toner concentration (%) in magnetic particles for electrostatic charge when mixtures of magnetic particles for electrostatic charge and toner, mixed at the above weight ratio, were used as the magnetic particles for electrostatic charge, a nonmagnetic sleeve having no resin coating of the present invention was used, and 100 copies were continuously formed in this state.

TABLE 3

The triboelectrification amount and the like of toner when different magnetic particles for electrostatic charge were used (a nonmagnetic sleeve having no resin coating was used)

| Magnetic particles for electrostatic charge | Toner triboelectrification amount (c/kg) | Toner concentration (%) after 100 copies |
|---|---|---|
| A | $+10 \times 10^{-3}$ | 0.95 |
| B | $-5 \times 10^{-3}$ | 0.12 |

TABLE 3-continued

The triboelectrification amount and the like of toner when different magnetic particles for electrostatic charge were used (a nonmagnetic sleeve having no resin coating was used)

| Magnetic particles for electrostatic charge | Toner triboelectrification amount (c/kg) | Toner concentration (%) after 100 copies |
|---|---|---|
| C | $-12 \times 10^{-3}$ | 0.18 |
| D | $-28 \times 10^{-3}$ | 0.38 |
| E | $-55 \times 10^{-3}$ | 0.65 |

Table 4 shows the results when a nonmagnetic sleeve having a resin coating like that used in Example 1 was used. Since an alternating voltage was applied in this example, when the magnetic particles A for electrostatic charge were used the concentration slightly lowered because the potential difference decreased. When the magnetic particles E for electrostatic charge were used, the discharging properties slightly improved by the removing effect by the alternating electric field, and the concentration lowered. However, when the magnetic particles B and C for electrostatic charge were used, the toner concentration slightly increased owing to a decreased potential difference.

TABLE 4

The triboelectrification amount and the like of toner when different magnetic particles for electrostatic charge were used (a resin-coated sleeve was used as a nonmagnetic sleeve)

| Magnetic particles for electrostatic charge | Toner triboelectrification amount (c/kg) | Toner concentration (%) after 100 copies |
|---|---|---|
| A | $+10 \times 10^{-3}$ | 0.85 |
| B | $-5 \times 10^{-3}$ | 0.09 |
| C | $-12 \times 10^{-3}$ | 0.12 |
| D | $-28 \times 10^{-3}$ | 0.15 |
| E | $-55 \times 10^{-3}$ | 0.28 |

Figure 8:
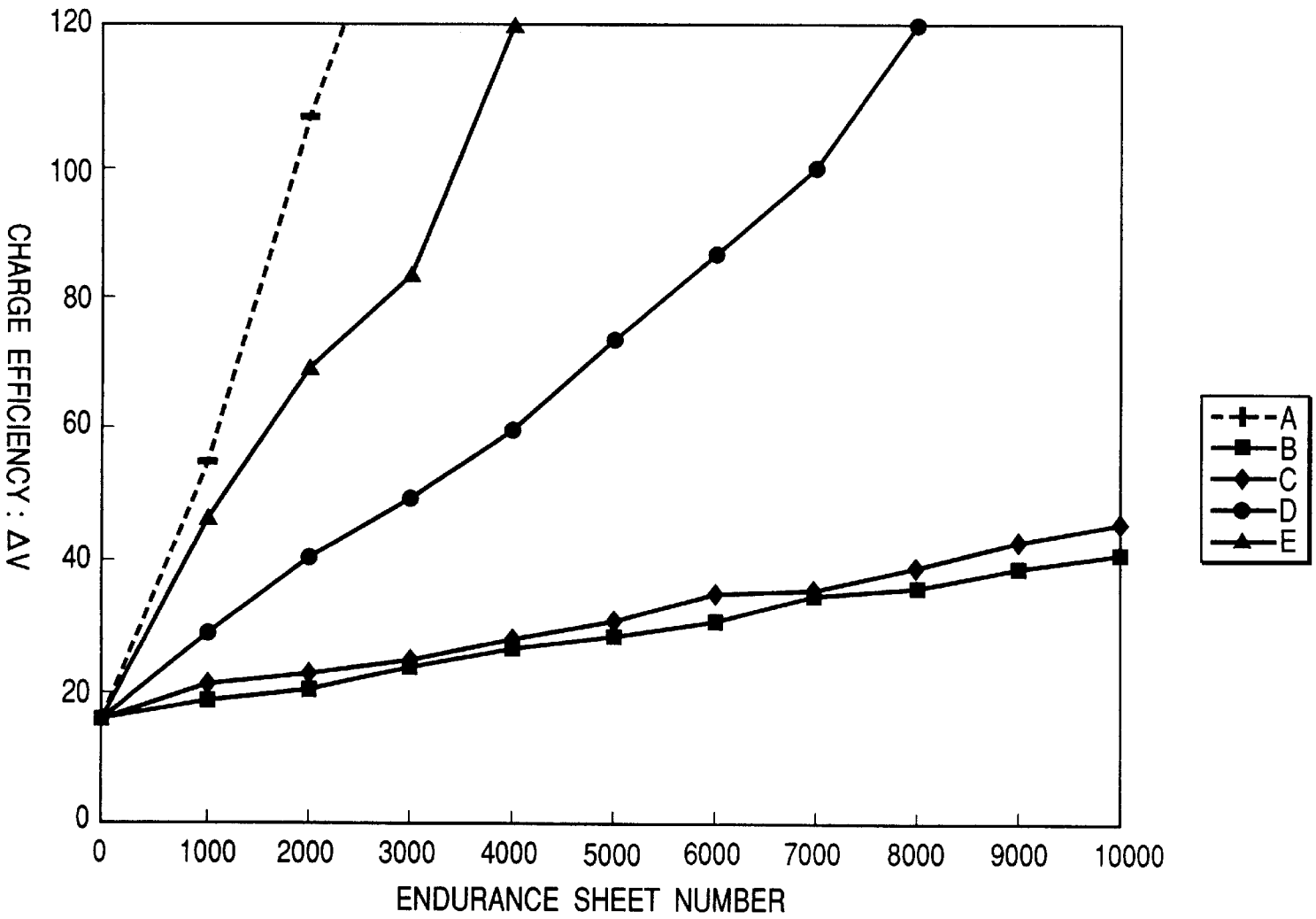
FIG. 8 is a graph showing variations in charge efficiency caused by endurance.

FIG. 8 shows variations in charge efficiency ΔV (=the difference between the saturation potential and the potential that can be charged in the first rotation) with an endurance of 10,000 copies, when a conventional nonmagnetic sleeve having no resin layer was used as a magnetic particle carrier. The results obtained by the magnetic particles A, B, C, D, and E for electrostatic charge are shown in FIG. 8. When the toner particles B and C were used, images could be output with no positive ghost up to 10,000 copies. When the magnetic particles D for electrostatic charge were used, positive ghost started to appear when about 2,000 copies were formed, and the charge efficiency so lowered that no images could be output when about 5,000 copies were formed. When the magnetic particles A and E for electrostatic charge were used, positive ghost started to appear when about 1,000 copies were formed, and the charge efficiency so lowered that no images could be output when about 2,000 copies were formed.

Figure 9:
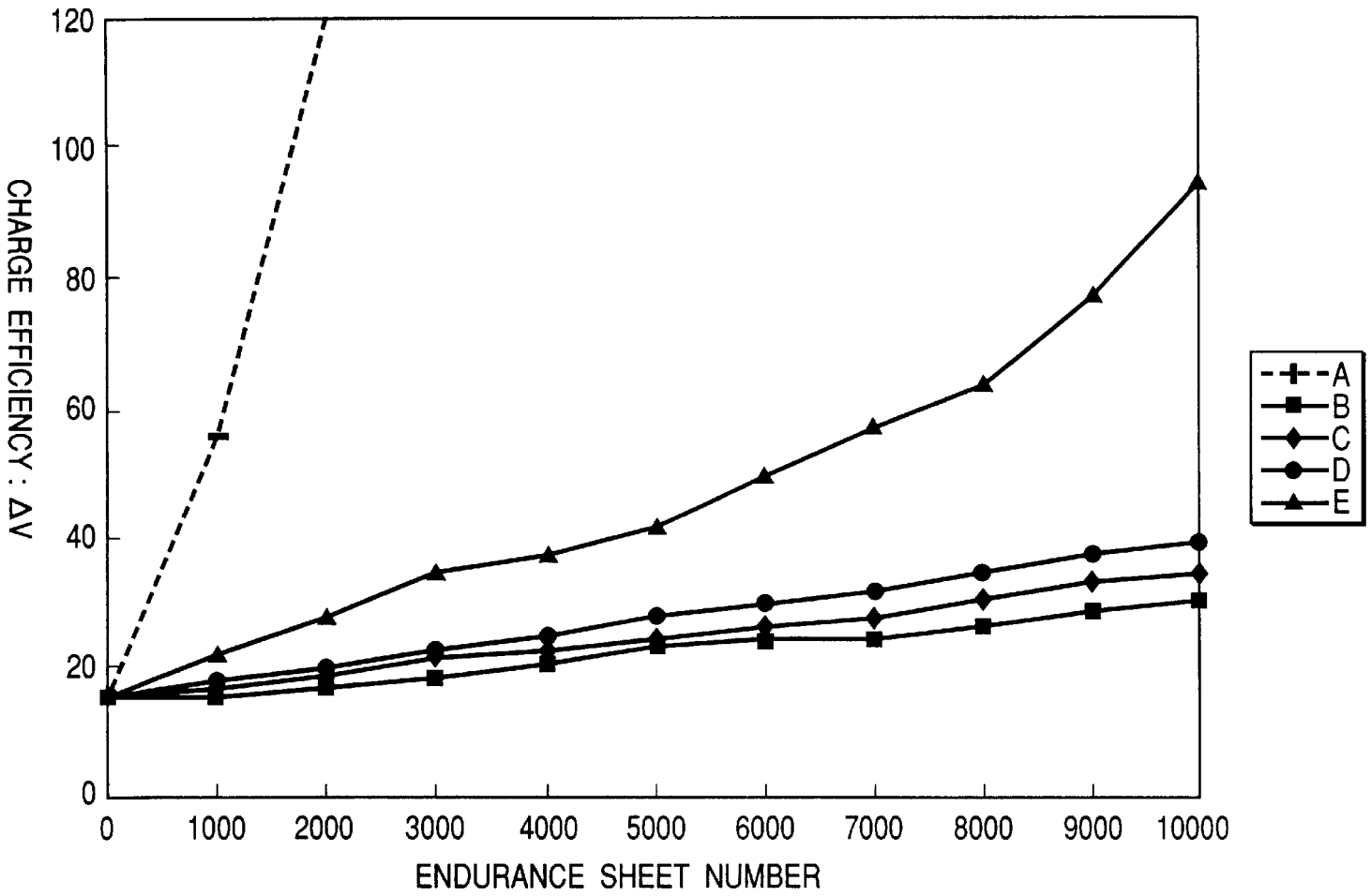
FIG. 9 is a graph showing variations in charge efficiency caused by endurance.

In contrast, FIG. 9 shows the results of an identical endurance test when the resin-coated sleeve used in this example was used. Although no effect was found when the magnetic particles A for electrostatic charge were used, images could be output with no positive ghost up to 10,000 copies when the magnetic particles B, C, and D for electrostatic charge were used. Furthermore, when the magnetic particles E for electrostatic charge were used, images could be output up to 10,000 copies, although positive ghost started to appear when about 5,000 copies were formed.

As described above, since a resin-coated sleeve is used as a nonmagnetic sleeve, even when an alternating voltage is superposed on the charging bias it is possible to prevent strong adhesion of toner to the surface of the nonmagnetic sleeve while maintaining the effect of increasing the charge efficiency. Additionally, charge-up itself by triboelectrification can be suppressed. Consequently, it is possible to increase the spurting efficiency of toner from the magnetic brush charger and maintain high charge efficiency. Also, the endurance greatly improves owing to the charge efficiency improving effect compared to that when only DC voltage is applied, although the toner mixing ratio slightly rises.

EXAMPLE 3

In Examples 1 and 2, the formulation of the resin-coated sleeve was set as shown in formulation (1) below. In Example 3, two types of resin-coated sleeves were manufactured by changing the composition ratio of resin, graphite, and carbon as indicated by formulations 2 and 3 below.

| | |
|---|---|
| (Formulation 1: used in Examples 1 and 2) | |
| •Resin: phenolic resin | 100 parts by weight |
| •Graphite: average particle size (7 μm) | 45 parts by weight |
| •Carbon: average particle size (0.2 μm) | 5 parts by weight |
| •Solvent: IPA (IsoPropyl Alcohol) | 100 parts by weight |
| (Formulation 2) | |
| •Resin: phenolic resin | 100 parts by weight |
| •Graphite: average particle size (7 μm) | 25 parts by weight |
| •Carbon: average particle size (0.2 μm) | 25 parts by weight |
| •Solvent: IPA (IsoPropyl Alcohol) | 100 parts by weight |
| (Formulation 3) | |
| •Resin: phenolic resin | 100 parts by weight |
| •Graphite: average particle size (7 μm) | 5 parts by weight |
| •Carbon: average particle size (0.2 μm) | 45 parts by weight |
| •Solvent: IPA (IsoPropyl Alcohol) | 100 parts by weight |

The nonmagnetic sleeves of the above three formulations and, as a control, a conventional nonmagnetic sleeve having no resin layer were used and the magnetic particles D for electrostatic charge used in Examples 1 and 2 were used to check for variations in charge efficiency ΔV (=the difference between the saturation potential and the potential that can be charged in the first rotation) in an image output endurance of 10,000 copies.

Figure 10:
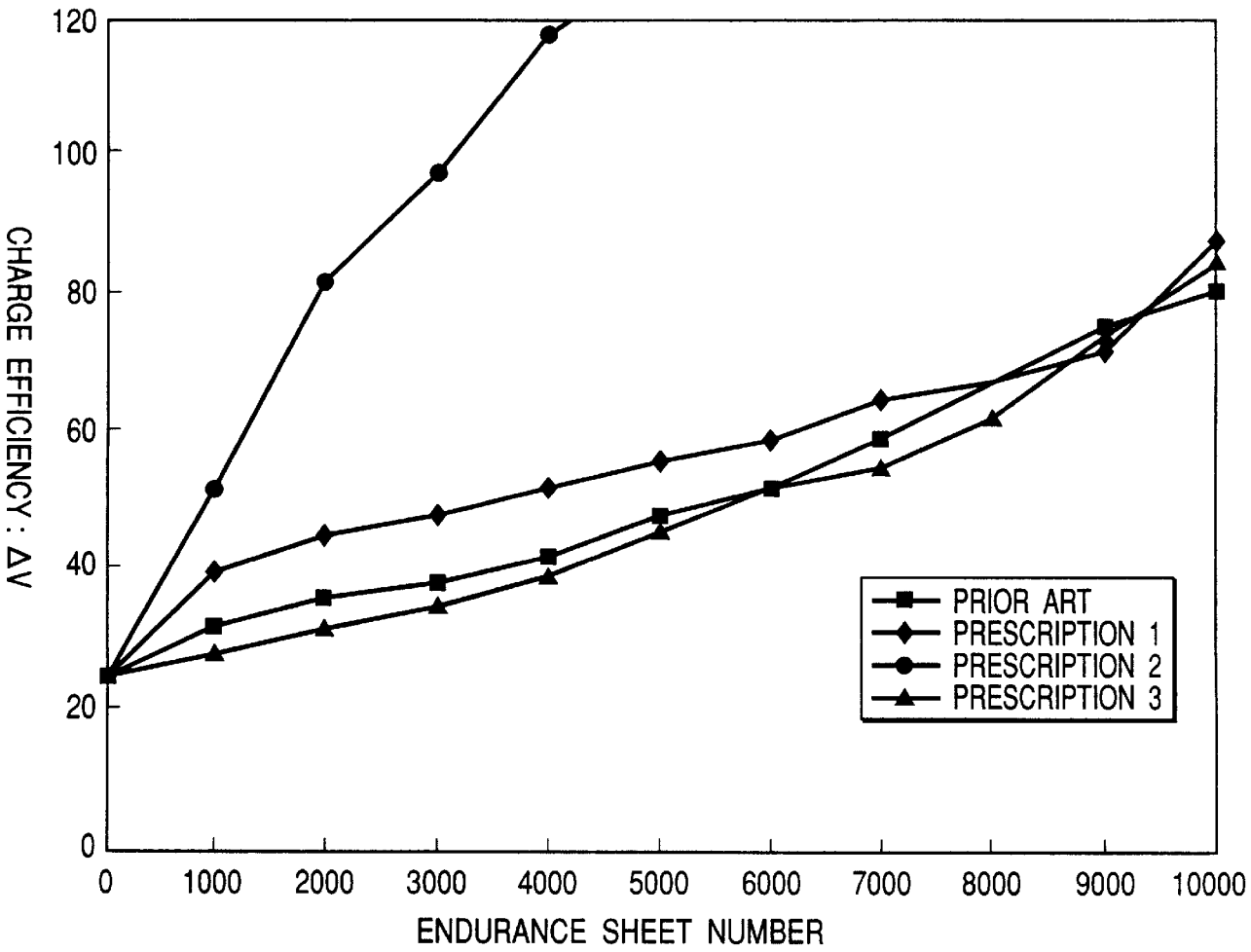
FIG. 10 is a graph showing variations in charge efficiency caused by endurance.
Figure 11:
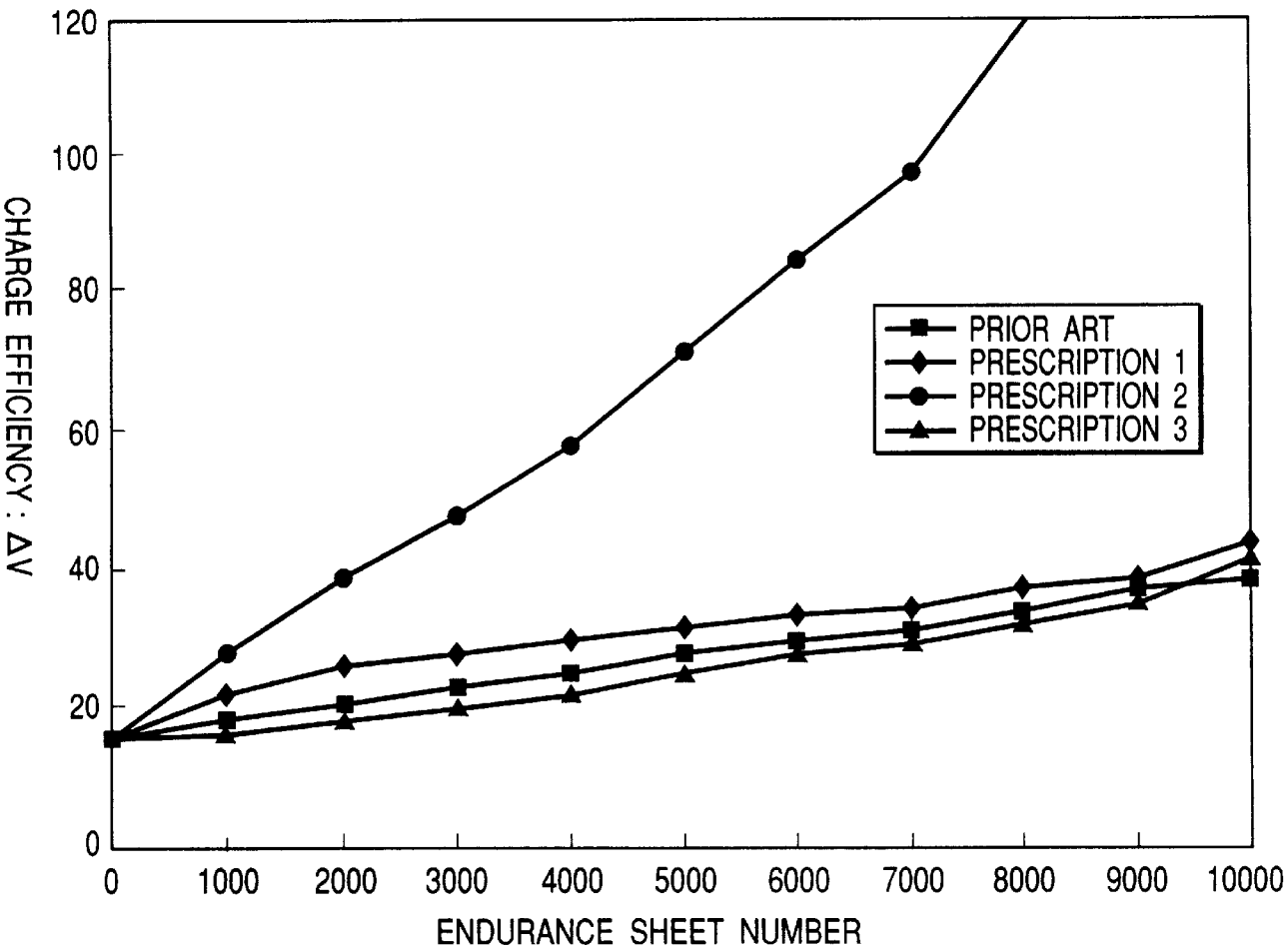
FIG. 11 is a graph showing variations in charge efficiency caused by endurance.

FIG. 10 shows the results when only a DC voltage of −650 V was applied to the nonmagnetic sleeves as in Example 1. FIG. 11 shows the results when an alternating voltage having a frequency of 1,000 Hz and an amplitude of 700 V was superposed on a DC voltage of −650 V as in Example 2. The results in FIGS. 10 and 11 show that the nonmagnetic sleeve of any formulation had the effect of maintaining the endurance. As described above, when a resin-coated sleeve having a resin layer is used as a nonmagnetic sleeve, the effect of the present invention can be obtained regardless of formulation.

In these examples, examinations were made by using a resin-coated sleeve having a conductive resin layer on an aluminum substrate as a magnetic brush charger 31. However, it is also possible to use a resin sleeve in which a substrate itself is made of a resin containing a fine conductive or semiconductive powder. In the examples, a magnet roller was fixed in a nonmagnetic sleeve rotating system. However, a system having the same arrangement except that a magnet roller is rotatable or a system comprising only a rotatable magnet roller can also be realized by coating the roller surface with a conductive resin layer as in the examples.

Furthermore, the image forming apparatus of the present invention is not limited to Examples 1 to 3 described above. That is, the present invention includes any arrangement meeting the conditions that, in an image forming apparatus in which a developing device also serves as a cleaner means, a charging member is a contact charging means using magnetic particles, and a magnetic particle carrier of this contact charging member has a resin layer containing a fine conductive or semiconductive powder on its surface or is manufactured by forming a resin sleeve containing a fine conductive or semiconductive powder on the surface of a substrate.

For example, a photosensitive body desirably has a low-resistance layer whose surface resistance is $10^9$ to $10^{14}$ Ω·cm, in order to realize charge injection and prevent the generation of ozone. However, a satisfactory effect of preventing an increase in the resistance of a charger can be obtained even with the use of an organic photosensitive body other than the above photosensitive body. Also, the two-component development method is described in Examples 1 to 3, but other development methods also have effects. Of these methods, mono-component contact development or two-component contact development which develops with a developer mix in contact with a photosensitive body is preferred, since either method effectively enhances the toner collecting effect during development. Toner particles in a developer mix can also be pulverized toner, and polymerized toner is more preferable. This is so because when polymerized toner is used it is possible to obtain a satisfactory effect of collecting untransferred toner not only in the mono-component contact development or the two-component contact development described above, but also in some other development method such as mono-component noncontact development or two-component noncontact development.

The examples of the present invention have been described above. However, the present invention is not limited to these examples and can be modified without departing from the technical idea of the invention.

What is claimed is:

1. An image forming apparatus comprising:

an image carrier;

charging means for charging said image carrier, said charging means charging at least in part using charging particles in contract with said image carrier during charging, said charging means having a particle carrier to carry the charging particles;

an electrostatic image forming means for forming an electrostatic image on said image carrier charged by said charging means; and developing means for developing said electrostatic image on said image carrier by toner;

wherein said particle carrier is formed with a surface resin layer containing a conductive material.

2. An apparatus according to claim 1, wherein said conductive material is a powder.

3. An apparatus according to claim 1, wherein said conductive material is one of graphite and carbon black.

4. An apparatus according to claim 1, wherein a resin for forming said resin layer comprises at least one resin selected from the group consisting of silicone resin, fluorine resin, polyethersulfone resin, polycarbonate resin, polyphenylene oxide resin, polyamide resin, phenolic resin, polyester resin, polyurethane resin, and styrene-based resin.

5. An apparatus according to claim 1, wherein triboelectrification polarity of toner with respect to said resin layer is the same as normal charging polarity of the toner.

6. An apparatus according to claim 1, further comprising:

transfer means for transferring the toner image on said image carrier onto a transfer material, wherein said charging means charges said image carrier from which untransferred residual toner is not removed.

7. An apparatus according to claim 1, wherein said charged particles are magnetic, and said particle carrier internally comprises a magnet.

* * * * *

UNITED STATES PATENT AND TRADEMARK OFFICE

CERTIFICATE OF CORRECTION

PATENT NO. : 6,295,428 B1
DATED : September 25, 2001
INVENTOR(S) : Hiroyuki Suzuki It is certified that error appears in the above-identified patent and that said Letters Patent is hereby corrected as shown below:

Column 2,
Line 16, "consumption" should read -- power consumption. --; and
Line 17, "power." should be deleted.

Column 6,
Line 67, "dried, and hardened" should read -- drying and hardening --.

Column 18,
Line 7, "contract" should read -- contact --.

Signed and Sealed this

Sixteenth Day of April, 2002

*Attest:*

*Attesting Officer*

JAMES E. ROGAN
*Director of the United States Patent and Trademark Office*